US006747615B2

(12) United States Patent
Jeong

(10) Patent No.: US 6,747,615 B2
(45) Date of Patent: Jun. 8, 2004

(54) METHOD OF DRIVING PLASMA DISPLAY PANEL INCLUDING AND-LOGIC AND LINE DUPLICATION METHODS, PLASMA DISPLAY APPARATUS PERFORMING THE DRIVING METHOD AND METHOD OF WIRING THE PLASMA DISPLAY PANEL

(75) Inventor: Jae-seok Jeong, Asan (KR)

(73) Assignee: Samsung SDI Co., Ltd., Suwon (KR)

( * ) Notice: Subject to any disclaimer, the term of this patent is extended or adjusted under 35 U.S.C. 154(b) by 258 days.

(21) Appl. No.: 09/983,940

(22) Filed: Oct. 26, 2001

(65) Prior Publication Data

US 2002/0057230 A1 May 16, 2002

(30) Foreign Application Priority Data

Nov. 14, 2000 (KR) ..... 2000-67467

(51) Int. Cl.[7] ..... G09G 3/28
(52) U.S. Cl. ..... 345/60; 345/67
(58) Field of Search ..... 345/60, 61, 62, 345/63, 66, 67, 68; 315/169.4

(56) References Cited

U.S. PATENT DOCUMENTS 5,854,540 A * 12/1998 Matsumoto et al. ..... 315/169.1
6,084,558 A * 7/2000 Setoguchi et al. ..... 345/60
6,127,992 A * 10/2000 Sano ..... 345/60
6,188,374 B1 * 2/2001 Moon ..... 345/60
6,256,002 B1 * 7/2001 Shinoda ..... 345/60
6,278,420 B1 8/2001 Mikoshiba et al.
6,288,691 B1 9/2001 Mikoshiba et al.
6,288,692 B1 * 9/2001 Kanazawa et al. ..... 345/67
6,411,268 B1 * 6/2002 Nakamura et al. ..... 345/60
6,448,947 B1 * 9/2002 Nagai ..... 345/60
6,531,995 B2 * 3/2003 Ishii et al. ..... 345/67

FOREIGN PATENT DOCUMENTS

KR P1998-086932 12/1998

* cited by examiner

*Primary Examiner*—Xiao Wu
(74) *Attorney, Agent, or Firm*—McGuireWoods LLP

(57) ABSTRACT

A method of driving a plasma display panel having a structure in which discharge cells are between a Y electrode line and adjacent X electrode lines thereabove and therebelow. The method includes dividing the X electrode lines into odd and even X groups, the Y electrode lines into Y groups such that pairs of X and Y groups include pairs of adjacent X and Y electrode lines, and the X and Y electrode lines are commonly connected to one another in units of the odd X groups, the even X groups, and the Y groups, driving the Y groups, the X groups, and the address electrode lines in an odd field to drive the odd discharge cells in a vertical direction, driving the Y groups, the X groups, and the address electrode lines in an even field to drive the even discharge cells in a vertical direction.

25 Claims, 10 Drawing Sheets

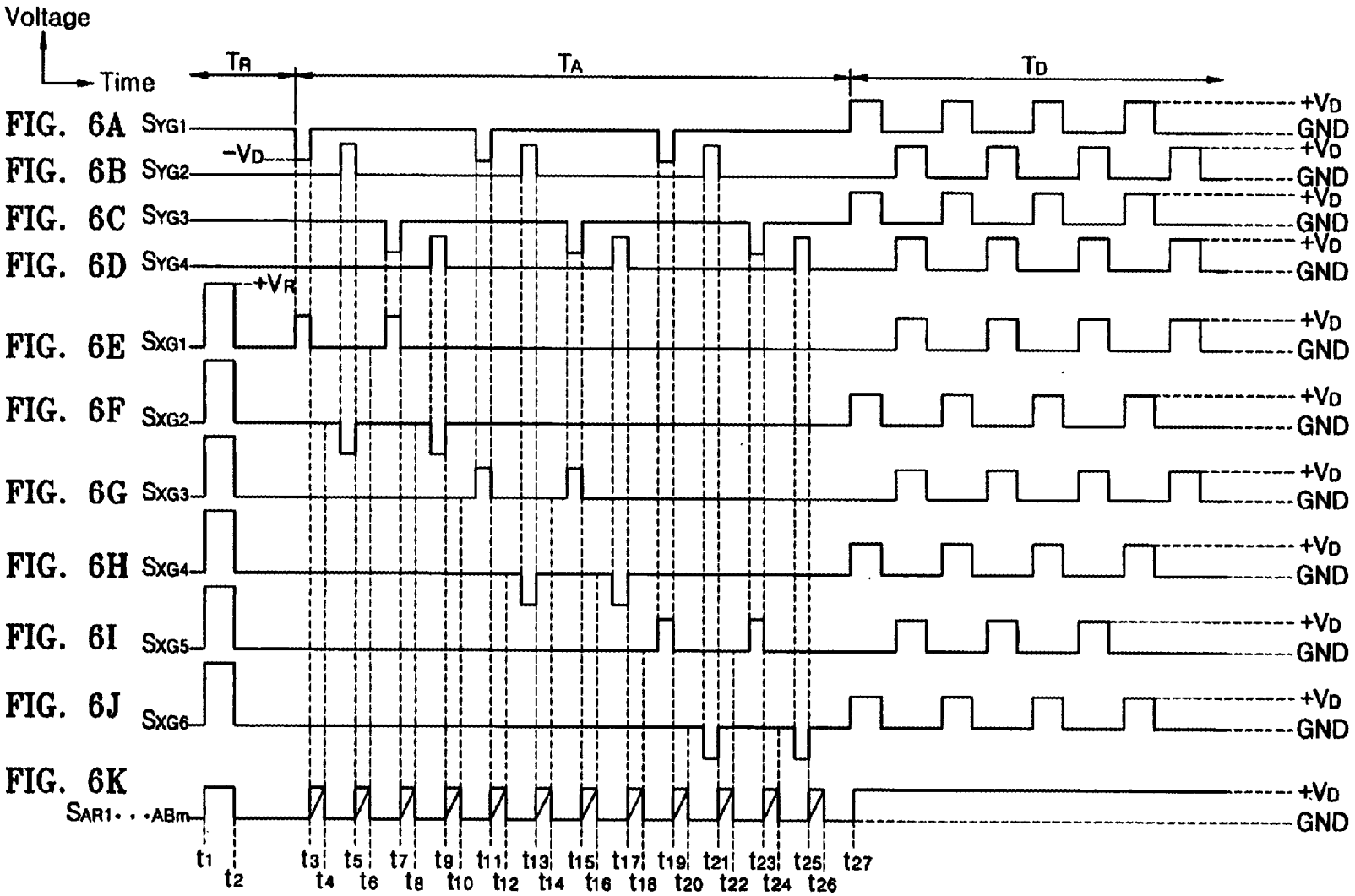
Voltage
Time
FIG. 6A SYG1
FIG. 6B SYG2
FIG. 6C SYG3
FIG. 6D SYG4
FIG. 6E SXG1
FIG. 6F SXG2
FIG. 6G SXG3
FIG. 6H SXG4
FIG. 6I SXG5
FIG. 6J SXG6
FIG. 6K SAR1 · · · ABm
TR
TA
TD
+VD
GND
-VD
+VR
t1 t2 t3 t4 t5 t6 t7 t8 t9 t10 t11 t12 t13 t14 t15 t16 t17 t18 t19 t20 t21 t22 t23 t24 t25 t26 t27

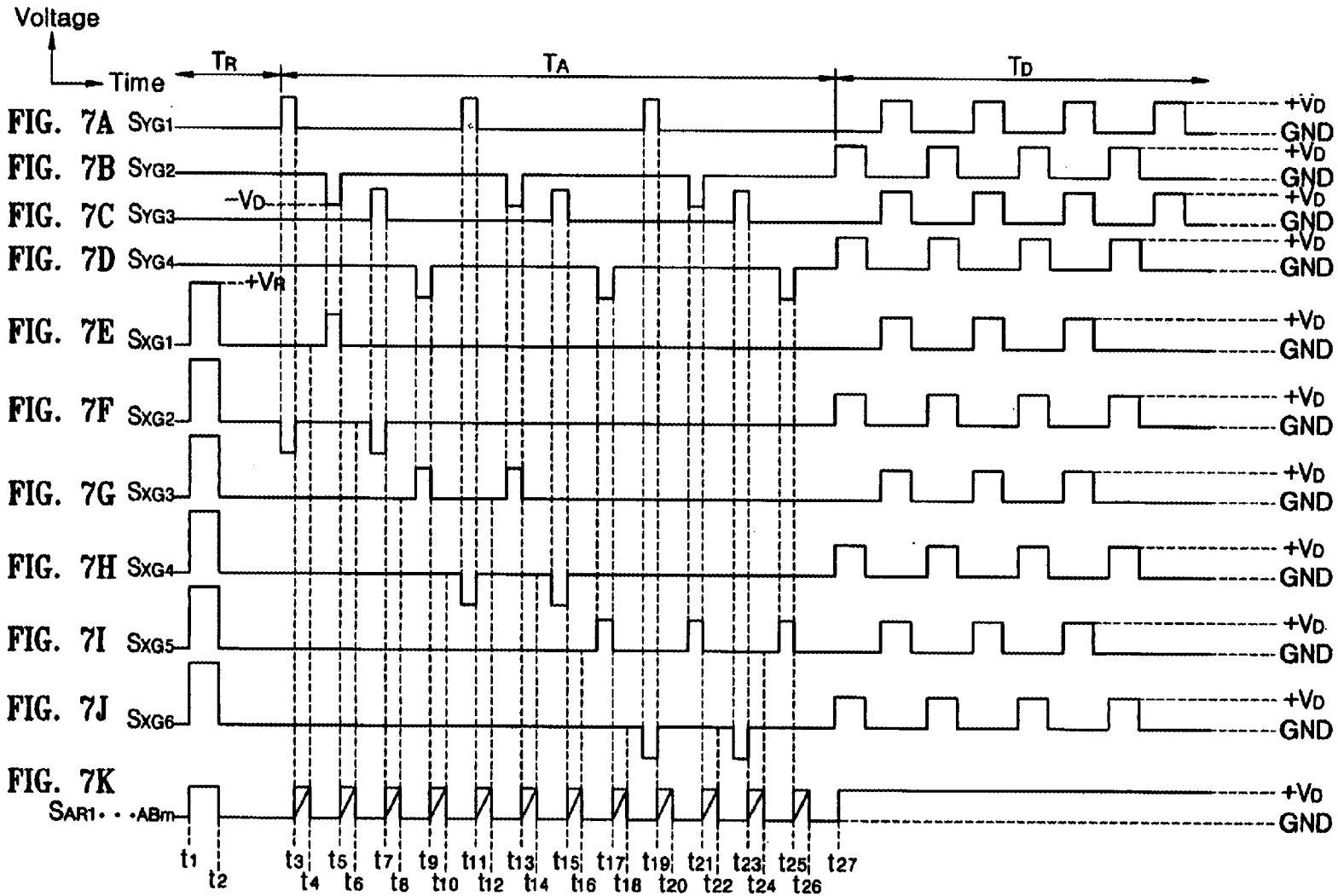
Voltage
Time
TR
TA
TD
FIG. 7A SYG1
FIG. 7B SYG2
FIG. 7C SYG3
FIG. 7D SYG4
FIG. 7E SXG1
FIG. 7F SXG2
FIG. 7G SXG3
FIG. 7H SXG4
FIG. 7I SXG5
FIG. 7J SXG6
FIG. 7K SAR1 · · ·ABm
+VD
GND
−VD
+VR
t1 t2 t3 t4 t5 t6 t7 t8 t9 t10 t11 t12 t13 t14 t15 t16 t17 t18 t19 t20 t21 t22 t23 t24 t25 t26 t27

METHOD OF DRIVING PLASMA DISPLAY PANEL INCLUDING AND-LOGIC AND LINE DUPLICATION METHODS, PLASMA DISPLAY APPARATUS PERFORMING THE DRIVING METHOD AND METHOD OF WIRING THE PLASMA DISPLAY PANEL

CROSS-REFERENCE TO RELATED APPLICATIONS

This application claims the benefit of Korean Application No. 00-67467, filed Nov. 14, 2000, in the Korean Industrial Property Office, the disclosure of which is incorporated herein by reference.

BACKGROUND OF THE INVENTION

1. Field of the Invention

The present invention relates to a method of driving a plasma display panel, and more particularly, to a method of driving a surface discharge type triode plasma display panel.

2. Description of the Related Art

FIG. 1 shows the structure of a surface discharge type triode plasma display panel 1. FIG. 2 shows a discharge cell of the plasma display panel 1 shown in FIG. 1. Referring to FIGS. 1 and 2, address electrode lines $A_{R1}, A_{G1}, \ldots, A_{Gm}, A_{Bm}$, dielectric layers 11 and 15, Y-electrode lines $Y_1, \ldots, Y_n$, X electrode lines $X_1, \ldots, X_n$, phosphor layers 16, partition walls 17, and a magnesium oxide (MgO) protective layer 12 are provided between front and rear glass substrates 10 and 13 of a general surface discharge plasma display panel 1.

The address electrode lines $A_{R1}, A_{G1}, \ldots, A_{Gm}, A_{Bm}$ are formed on the front surface of the rear glass substrate 13 in a predetermined pattern. The lower dielectric layer 15 is formed on the front surfaces of the address electrode lines $A_{R1}, A_{G1}, \ldots, A_{Gm}, A_{Bm}$. The partition walls 17 are formed on the front surface of the lower dielectric layer 15 to be parallel to the address electrode lines $A_{R1}, A_{G1}, \ldots, A_{Gm}, A_{Bm}$. These partition walls 17 define the discharge areas of respective discharge cells and prevent cross talk between discharge cells. The phosphor layers 16 are deposited between the partition walls 17.

The X electrode lines $X_1, \ldots, X_n$ and the Y-electrode lines $Y_1, \ldots, Y_n$ are formed on the rear surface of the front glass substrate 10 in a predetermined pattern to be orthogonal to the address electrode lines $A_{R1}, A_{G1}, \ldots, A_{Gm}, A_{Bm}$. The respective intersections define discharge cells. Each of the X electrode lines $X_1, \ldots, X_n$ includes a transparent conductive indium tin oxide (ITO) electrode line $X_{na}$ (FIG. 2) and a metal bus electrode line $X_{nb}$ (FIG. 2). Each of the Y-electrode lines $Y_1, \ldots, Y_n$ includes an ITO electrode line $Y_{na}$ (FIG. 2) and a metal bus electrode line $Y_{nb}$ (FIG. 2). The upper dielectric layer 11 is formed on the rear surfaces of the X electrode lines $X_1, \ldots, X_n$ and the Y-electrode lines $Y_1, \ldots, Y_n$. The MgO protective layer 12 protects the panel 1 against a strong electrical field and is deposited on the entire rear surface of the upper dielectric layer 11. A gas, which is used to from a plasma, is hermetically sealed in a discharge space 14.

A driving method fundamentally adapted to such a plasma display panel 1 as described above is to sequentially perform an initialization step, an address step, and a display step in a unit sub-field. In the initialization step, residual wall charges in the previous sub-field are erased, and space charges are uniformly generated. In the address step, wall charges are produced at selected discharge cells. In the display step, light is emitted from the discharge cells having the wall charges formed in the address step. In other words, when a current (AC) pulse of a relatively high voltage is alternately applied to all the X electrode lines $X_1, \ldots, X_n$ and all the Y-electrode lines $Y_1, \ldots, Y_n$, surface discharges occur at the discharge cells at which the wall charges are formed. Then, plasma is formed in a gas layer of the discharge space 14, and the phosphor layers 16 are excited due to radiation of ultraviolet rays from the plasma to generate light. Here, to realize gray scales on the plasma display panel 1, a time division driving method of dividing a unit display period (i.e., a frame) into sub-fields having different display times is used. For example, to achieve a 256 ($2^8$) gray scale level with 8-bit image data, 8 sub-fields are set in each unit display period (i.e., a frame in a progressive driving mode or a field in an interlaced driving mode).

For a method of driving such a plasma display panel, a line duplication method of setting discharge cells with respect to both two X electrode lines adjacent to each Y electrode line has been disclosed such as in Japanese Patent Publication No. 160525). According to this line duplication method, the number of X and Y driving lines can be reduced, but the number of driving devices of X and Y driving circuits cannot be eventually reduced.

SUMMARY OF THE INVENTION

To solve the above and other problems, it is an object of the present invention to provide a method of driving a plasma display panel in which a number of driving devices of X and Y driving circuits can be eventually reduced by using an AND-logic driving method and in which a number of X and Y driving lines can be eventually reduced by using a line duplication driving method.

Additional objects and advantages of the invention will be set forth in part in the description which follows and, in part, will be obvious from the description, or may be learned by practice of the invention.

To achieve the above and other objects, a method of driving a plasma display panel, where the plasma display panel includes front and rear substrates disposed opposite each other, X electrode lines and Y electrode lines arranged in parallel on the front substrate between the front and rear substrates, and address electrode lines disposed on the rear substrate in a direction orthogonal to a direction of the X electrode lines and the Y-electrode lines to define discharge cells at intersections thereof, where the discharge cells include odd and even discharge cells set between each Y electrode line and both adjacent X electrode lines above and below each Y electrode line, the method according to an embodiment of the present invention includes a wiring operation, an odd driving operation, and an even driving operation.

According to an aspect of the invention, in the wiring operation, the X electrode lines are divided into odd X groups and even X groups, the Y electrode lines are divided into Y groups, pairs of X and Y groups including pairs of adjacent X and Y electrode lines, respectively, are separately set, and the X and Y electrode lines are commonly connected to one another in units of the odd X groups, the even X groups, and the Y groups.

According to another aspect of the invention, in the odd driving operation, the Y groups, the X groups, and the address electrode lines in an odd field are driven so that odd discharge cells in a vertical direction are driven.

According to yet another aspect of the invention, in the even driving operation, the Y groups, the X groups, and the address electrode lines in an even field are driven so that even discharge cells in a vertical direction are driven.

In a method of driving a plasma display panel according to another embodiment of the present invention, the discharge cells are set using pairs of the X electrode lines adjacent to each one of the Y electrode lines, where the X electrode lines are divided into odd X groups and even X groups, and interlaced scanning is performed by an odd driving operation and an even driving operation, thereby realizing line duplication driving method.

According to a further aspect of the invention, the Y electrode lines are divided into Y groups, and pairs of the X and Y groups including corresponding pairs of the adjacent X and Y electrode lines, respectively, are separately set, and the odd driving operation and the even driving operation are performed in this structure to realize an AND-logic driving method.

BRIEF DESCRIPTION OF THE DRAWINGS

The above and other objects and advantages of the present invention will become more apparent and more readily appreciated by describing in detail preferred embodiments thereof with reference to the accompanying drawings in which:

FIGS. 6A through 6K are driving timing charts of unit sub-fields in an odd field according to another embodiment of the wiring structure of FIG. 3;

FIGS. 7A through 7K are driving timing charts of unit sub-fields in an even field according to another embodiment of the wiring structure of FIG. 3;

DETAILED DESCRIPTION OF THE PREFERRED EMBODIMENTS

Figure 1:
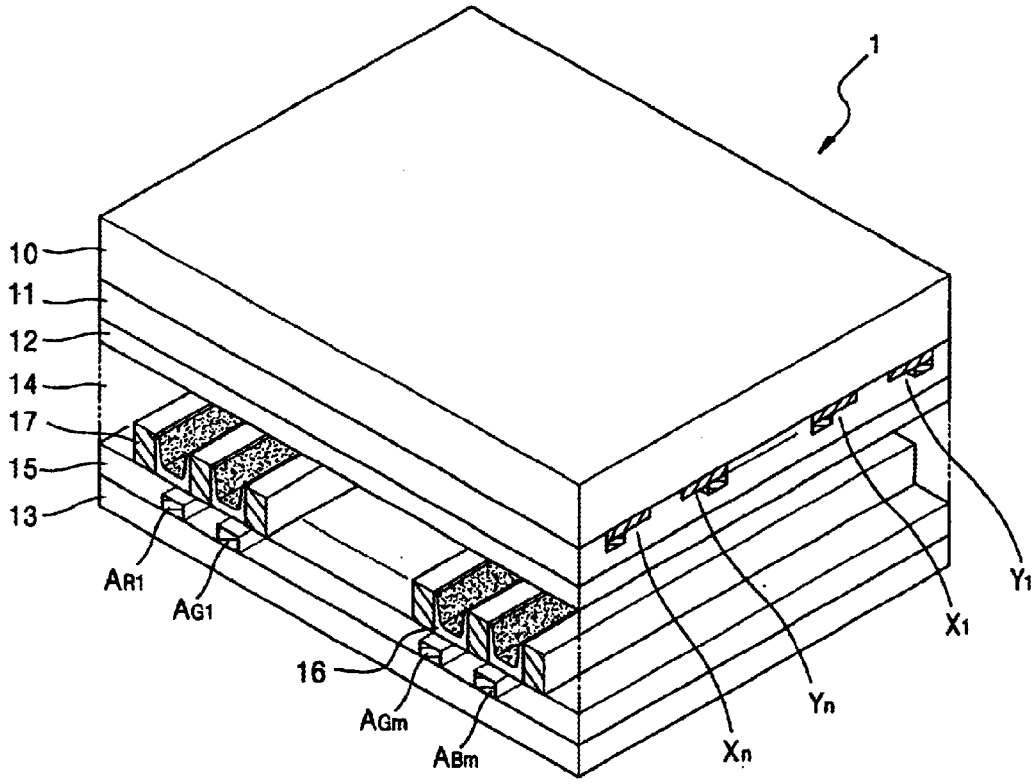
FIG. 1 (PRIOR ART)
FIG. 1 is an internal perspective view of a conventional surface discharge type triode plasma display panel.
Figure 2:
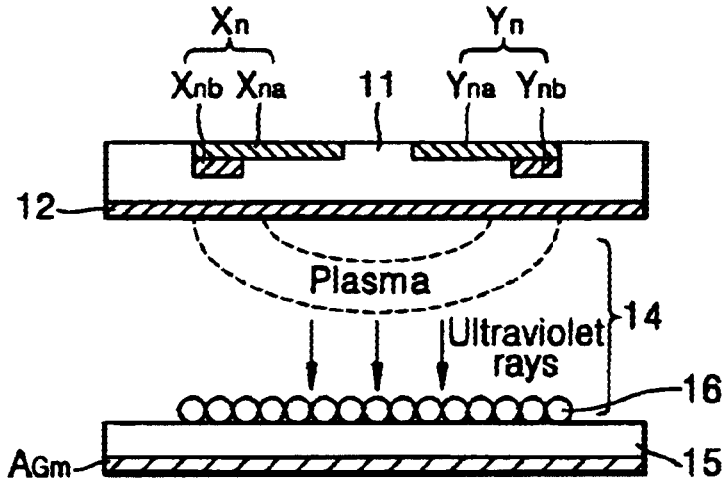
FIG. 2 (PRIOR ART)
FIG. 2 is a sectional view of an example of a single discharge cell of the conventional panel shown in FIG. 1.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

The present applicant has also introduced an AND-logic driving method of dividing the X electrode lines into a plurality of X groups, dividing the Y-electrode lines into a plurality of Y groups, separately setting XY groups so that each XY group includes a pair of adjacent X and Y electrode lines, and commonly and electrically connecting and driving the X and Y electrode lines in the unit of an XY group. According to this AND-logic driving method, the number of driving devices for X and Y driving circuits can be eventually reduced. However, since a line duplication driving method is not used, the number of X and Y driving lines cannot be reduced.

Figure 3:
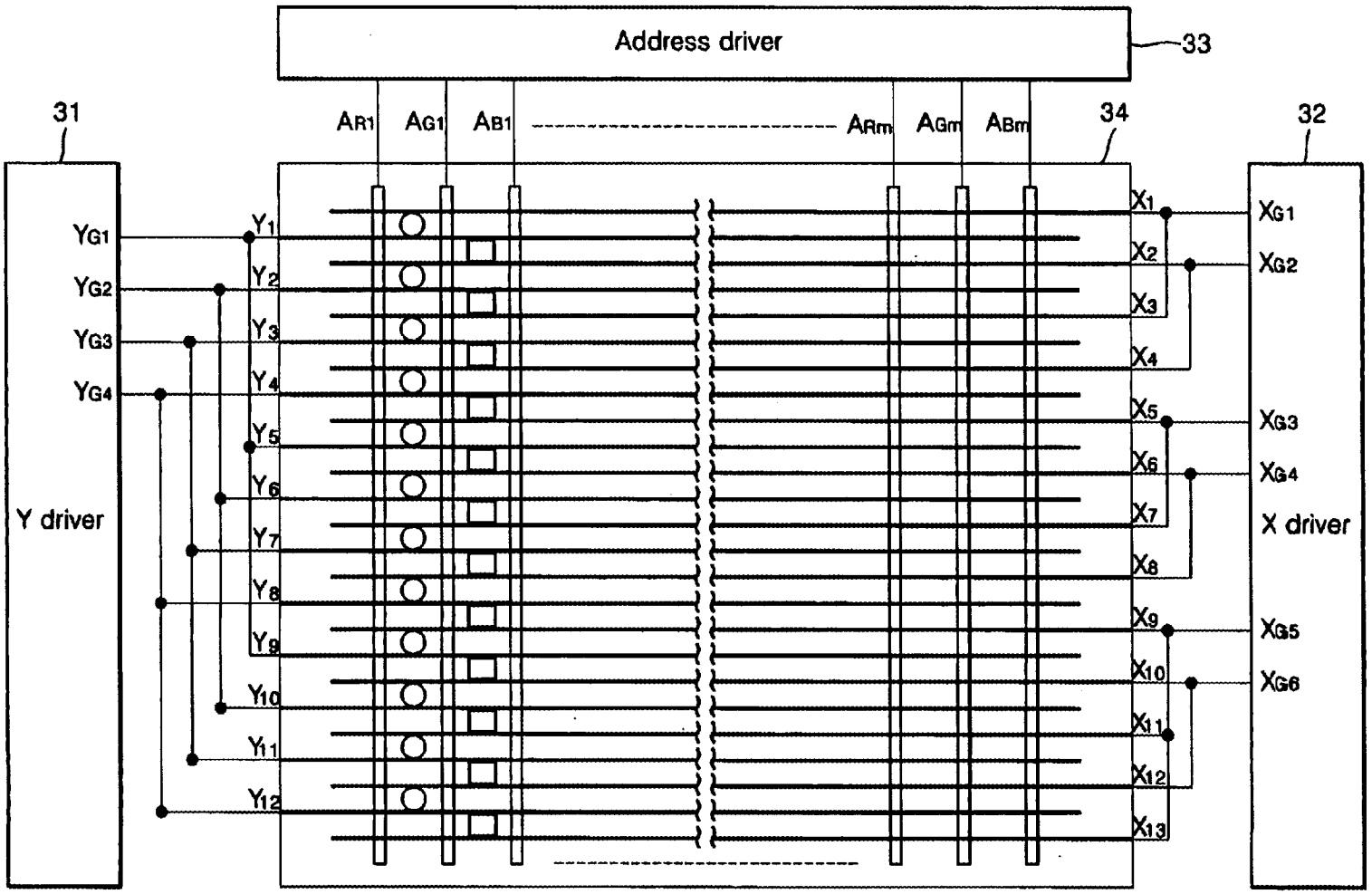
FIG. 3 is a wiring diagram of electrode lines of a plasma display panel according to an embodiment of a driving method of the present invention.
Figures 4A, 4B, 4C, 4D, 4E, 4F, 4G, 4H, 4I, 4J, 4K:
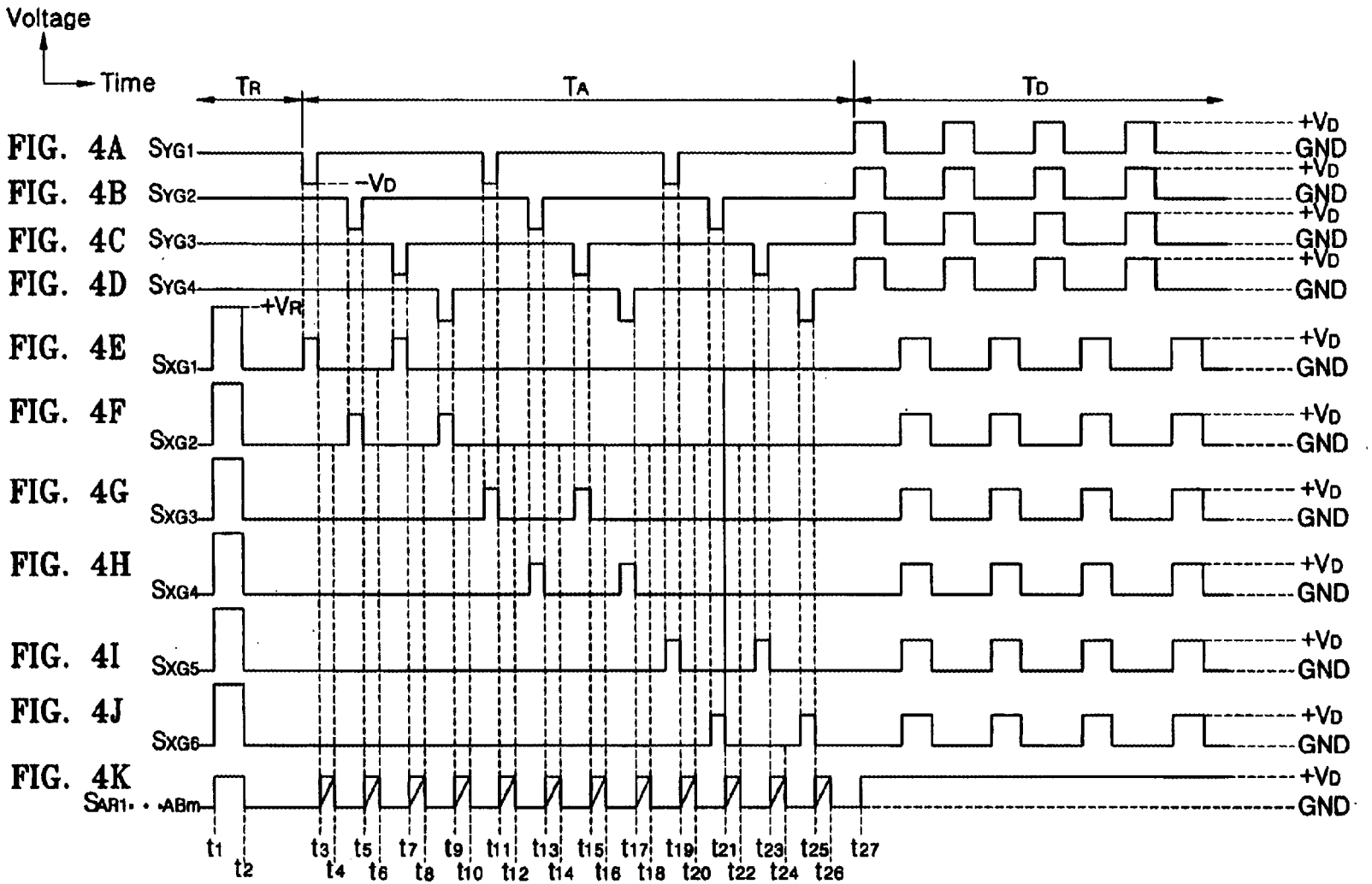
FIGS. 4A through 4K are driving timing charts of unit sub-fields in an odd field according to an embodiment of the wiring structure of FIG. 3.
Figures 5A, 5B, 5C, 5D, 5E, 5F, 5G, 5H, 5I, 5J, 5K:
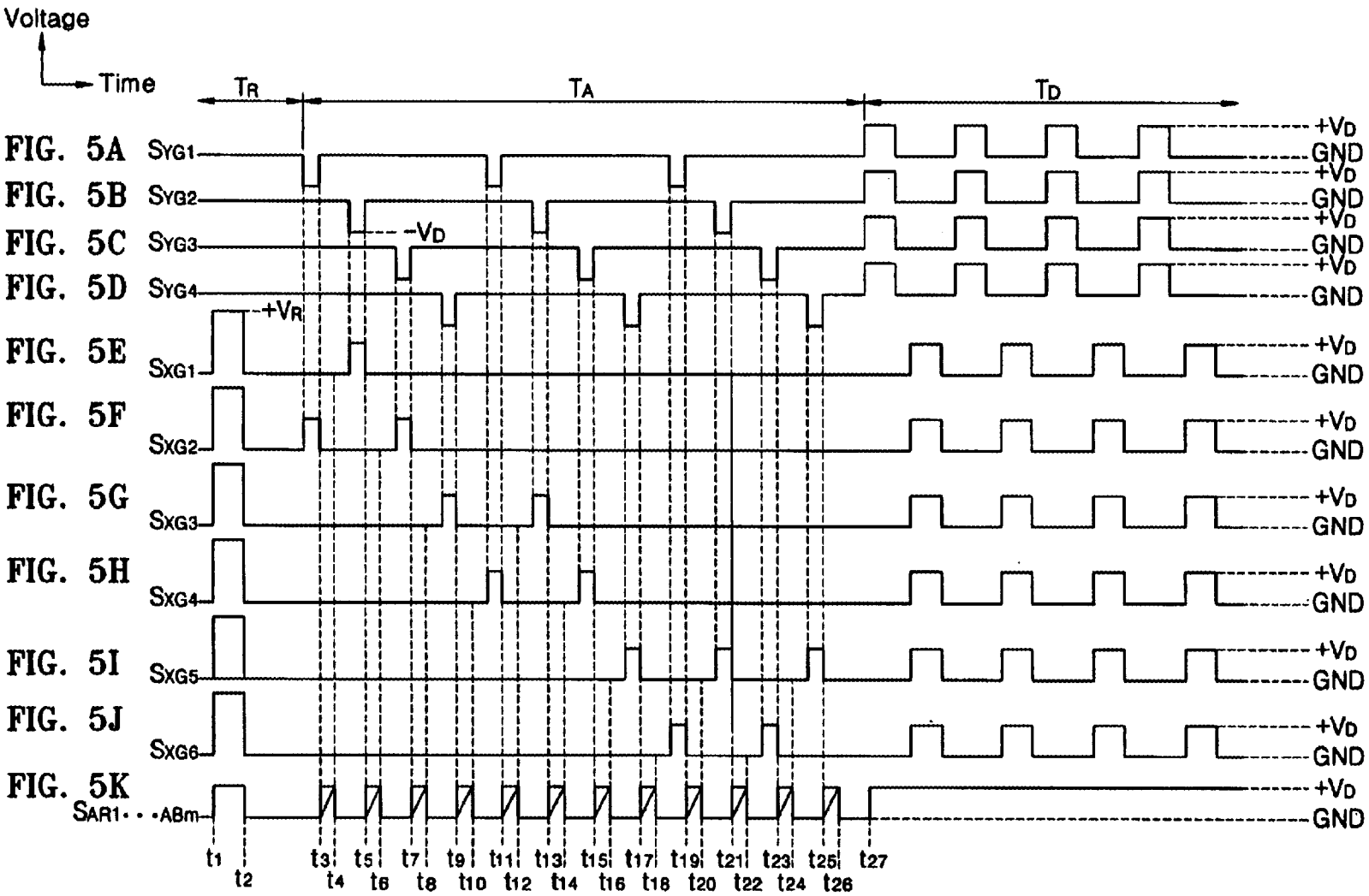
FIGS. 5A through 5K are driving timing charts of unit sub-fields in an even field according to an embodiment of the wiring structure of FIG. 3.

Referring to FIG. 3, a plasma display panel 34 to which a driving method according to an embodiment of the present invention is applied has a structure in which discharge cells are set not only between a Y electrode line and an adjacent X electrode line above, but are also between the Y electrode line and an adjacent X electrode line below. Thus, each Y electrode line defines discharge cells between adjacent X electrode lines. Here, only a single X electrode line is formed between adjacent Y electrode lines so that the total number of X electrode lines is n (i.e., 13) and the total number of Y electrode lines is n−1 (i.e., 12).

X electrode lines $X_1, \ldots, X_{13}$ are divided into three odd X groups $X_{G1}$, $X_{G3}$ and $X_{G5}$ of odd X electrode lines, and three even X groups $X_{G2}$, $X_{G4}$ and $X_{G6}$ of even X electrode lines. Y electrode lines $Y_1, \ldots, Y_{13}$ are divided into four Y groups $Y_{G1}, \ldots, Y_{G4}$. Pairs of XY groups $X_{G1}Y_{G1}$, $Y_{G1}X_{G2}$, $X_{G2}Y_{G2}$, $Y_{G2}X_{G1}$, . . . , $X_{G6}Y_{G4}$, $Y_{G4}X_{G5}$ are organized such that each includes a corresponding pair of adjacent X and Y electrodes $X_1Y_1$, $Y_1X_2$, $X_2Y_2$, $Y_2X_3$, . . . , $X_{12}Y_{12}$, $Y_{12}X_{13}$. Accordingly, the X and Y electrode lines are commonly connected to one another in units of odd X groups $X_{G1}$, $X_{G3}$ and $X_{G5}$, even X groups $X_{G2}$, $X_{G4}$ and $X_{G6}$, and Y groups $Y_{G1}, \ldots, Y_{G4}$. Since the number of Y groups $Y_{G1}, \ldots, Y_{G4}$, is an even number (i.e., 4), the number of Y groups (i.e., 2) corresponding to the odd X groups $X_{G1}$ and $X_{G3}$ is the same as the number of Y groups (i.e., 2) corresponding to the even X groups $X_{G2}$, $X_{G4}$ and $X_{G6}$. However, the number of Y groups (i.e., 3) corresponding to the last odd X group $X_{G5}$ is one more than the number of Y groups corresponding to the other X groups to avoid using an additional driving device to drive the last X electrode line $X_{13}$.

An address driver 33 generates a data signal to drive address electrode lines $A_{R1}$, $A_{G1}$, . . . , $A_{Gm}$, $A_{Bm}$. An X driver 32 drives the X groups $X_{G1}, \ldots, X_{G6}$, and a Y driver 31 drives Y groups $Y_{G1}, \ldots, Y_{G4}$.

FIGS. 4A through 4K are driving timing charts of unit sub-fields in an odd field according to the embodiment of the wiring structure shown in FIG. 3. In FIG. 4, reference characters $S_{YG1}, \ldots, S_{YG4}$ denote driving signals applied to first through fourth Y groups ($Y_{G1}, \ldots, Y_{G4}$ of FIG. 3), respectively. Reference characters $S_{XG1}, \ldots, S_{XG6}$ denote driving signals for first through sixth X groups ($X_{G1}, \ldots, X_{G6}$ of FIG. 3), respectively. Reference character $S_{AR1}, \ldots$, ABm denotes a data signal applied to all the address electrode lines ($A_{R1}$, $A_{G1}$, . . . , $A_{Gm}$, $A_{Bm}$ of FIG. 3). Reference characters $T_R$, $T_A$ and $T_D$ denote a reset period, an address period, and a display period, respectively.

During the reset period $T_R$, a pulse of relatively high positive voltage $+V_R$ is applied to all the X groups $X_{G1}, \ldots, X_{G6}$, thereby erasing wall charges from all discharge cells. A period of time while this pulse is applied (i.e., a pulse width) is the interval between a point t1 and a point t2 and is relatively long.

During the address period $T_A$, in the order of the horizontal lines, the wall charges are formed in all odd discharge cells and then the wall charges are erased from ones of the odd discharge cells which are not to be displayed. Immediately before a point t3, scan pulses having different polarities are applied to the first Y group $Y_{G1}$ and the first X group $X_{G1}$, respectively, corresponding to first odd discharge cells to form the wall charges in the first odd discharge cells. In other words, a pulse of a negative voltage $-V_D$ is applied to the first Y group $Y_{G1}$, and simultaneously, a pulse of a positive voltage $+V_D$ is applied to the first X group $X_{G1}$. As a result, a voltage $2V_D$ is applied between the first Y electrode line $Y_1$ and the first X electrode line $X_1$, thereby provoking a discharge therein to form the wall charges.

Subsequently, during the interval between a point tb3 and t4, a data signal is applied to all the address electrode lines $A_{R1}, A_{G1}, \ldots, A_{Gm}, A_{Bm}$, thereby erasing the wall charges from ones of the discharge cells which are not to be displayed among the first odd discharge cells having the wall charges. Here, the voltage $+V_D$ and the width of an address pulse are set to be proper to erase the wall charges.

The above-described addressing operations are sequentially performed on the remaining odd discharge cells.

Next, during the display period $T_D$, a pulse of a positive voltage $+V_D$ is alternately applied to all the Y groups $Y_{G1}, \ldots, Y_{G4}$ and all the X groups $X_{G1}, \ldots, X_{G6}$, thereby provoking display discharge in the discharge cells from which the wall charges have not been erased during the address period $T_A$.

FIGS. 5A through 5K are driving timing charts of unit sub-fields in an even field according to the embodiment of the wiring structure shown in FIG. 3. In FIGS. 4A through 4K and 5A through 5K, the same reference numerals denote members having the same function.

During a reset period $T_R$, a pulse of relatively high positive voltage $+V_R$ is applied to all the X groups $X_{G1}, \ldots, X_{G6}$, thereby erasing the wall charges from all the discharge cells. A period of time while this pulse is applied (i.e., a pulse width) is the interval between a point t1 and a point t2 and is relatively long.

During an address period $T_A$, in the order of the horizontal lines, the wall charges are formed in all even discharge cells, and then the wall charges are erased from ones of the even discharge cells which are not to be displayed. Immediately before a point t3, scan pulses having different polarities are applied to the first Y group $Y_{G1}$ and the second X group $X_{G2}$, respectively, corresponding to first even discharge cells, thereby forming the wall charges in the first even discharge cells. In other words, a pulse of a negative voltage $-V_D$ is applied to the first Y group $Y_{G1}$, and simultaneously, a pulse of a positive voltage $+V_D$ is applied to the second X group $X_{G2}$. As a result, a voltage $2V_D$ is applied between the first Y electrode line $Y_1$ and the second X electrode line $X_2$, thereby provoking a discharge therein to form the wall charges.

Subsequently, during the interval between the point t3 and a point t4, a data signal is applied to all the address electrode lines $A_{R1}, A_{G1}, \ldots, A_{Gm}, A_{Bm}$, thereby erasing the wall charge from the discharge cells which are not to be displayed among the first even discharge cells having wall charges. Here, the voltage $+V_D$ and the width of an address pulse are set to be proper to erase the wall charges.

The above-described addressing operations are sequentially performed on the remaining even discharge cells.

Next, during the display period $T_D$, a pulse of a positive voltage $+V_D$ is alternately applied to all the Y groups $Y_{G1}, \ldots, Y_{G4}$ and all the X groups $X_{G1}, \ldots, X_{G6}$, thereby provoking a display discharge in the ones of the discharge cells from which the wall charges have not been erased during the address period $T_A$.

FIGS. 6A through 6K are driving timing charts of unit sub-fields in an odd field according to another embodiment of the wiring structure of FIG. 3. In FIGS. 4A through 4K and 6A through 6K, the same reference numerals denote members having the same function.

Only differences between the driving method shown in FIGS. 6A through 6K and the driving method shown in FIGS. 4A through 4K will be described below. During an address period $T_A$, the polarity of a scan pulse applied to form the wall charges is sequentially inverted so as to not influence states of the even discharge cells adjacent the odd discharge cells in which the wall charges will be formed. For example, immediately before a point t3, a negative voltage $-V_D$ is applied to the first Y group $Y_{G1}$, and a positive voltage $+V_D$ is applied to the first X group $X_{G1}$. In contrast, immediately before a point t5, a positive voltage $+V_D$ is applied to the second Y group $Y_{G2}$, and a negative voltage $-V_D$ is applied to the second X group $X_{G2}$.

FIGS. 7A through 7K are driving timing charts of unit sub-fields in an even field according to another embodiment of the wiring structure of FIG. 3. In FIGS. 7A through 7K and 5A through 5K, the same reference numerals denote members having the same function.

Only differences between the driving method shown in FIGS. 7A through 7K and the driving method shown in FIGS. 5A through 5K will be described below. During an address period $T_A$, the polarity of a scan pulse applied to form the wall charges is sequentially inverted so as to not influence the states of odd discharge cells adjacent even discharge cells in which the wall charges will be formed. For example, immediately before a point t3 , a positive voltage $+V_D$ is applied to the first Y group $Y_{G1}$, and a negative voltage $-V_D$ is applied to the second X group $X_{G2}$. In contrast, immediately before a point t5, a negative voltage $-V_D$ is applied to the second Y group $YG_2$, and a positive voltage $+V_D$ is applied to the first X group $X_{G1}$.

Figure 8:
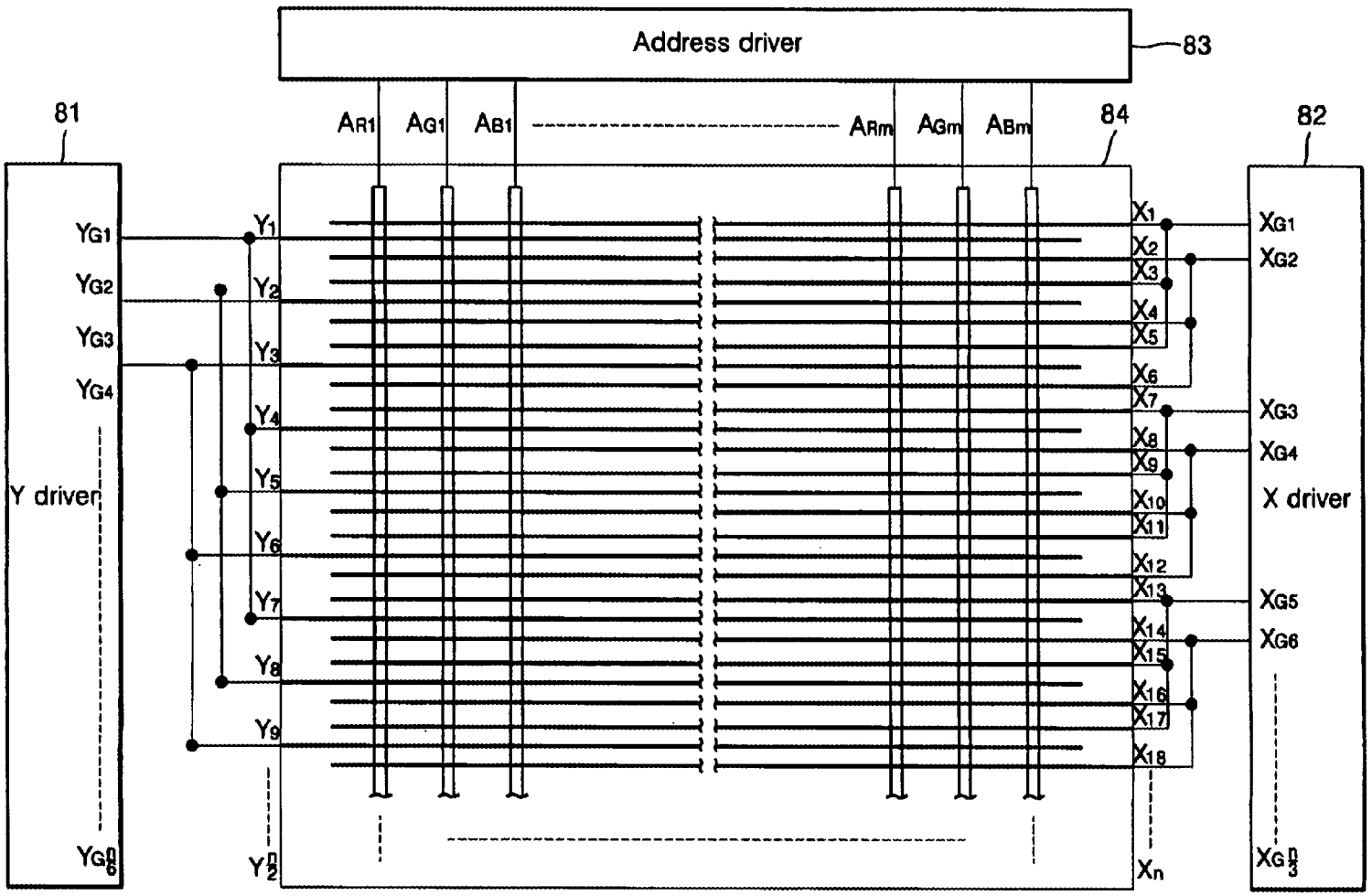
FIG. 8 is a wiring diagram of electrode lines of a plasma display panel according to a further embodiment of a driving method of the present invention.
Figures 9A, 9B, 9C, 9D, 9E, 9F, 9G, 9H, 9I, 9J:
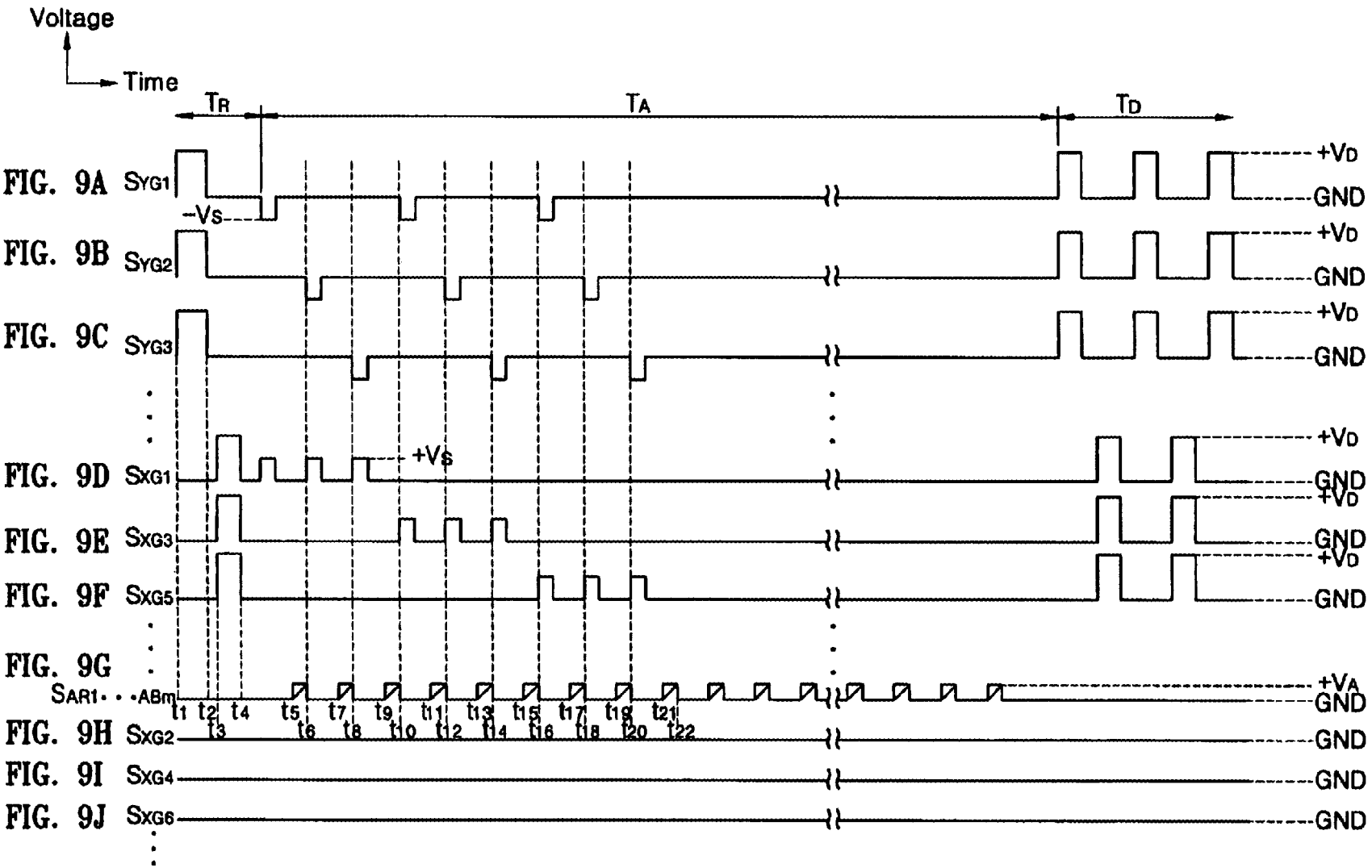
FIGS. 9A through 9J are driving timing charts of unit sub-fields in an odd field in the wiring structure of FIG. 8.
Figures 10A, 10B, 10C, 10D, 10E, 10F, 10G, 10H, 10I, 10J:
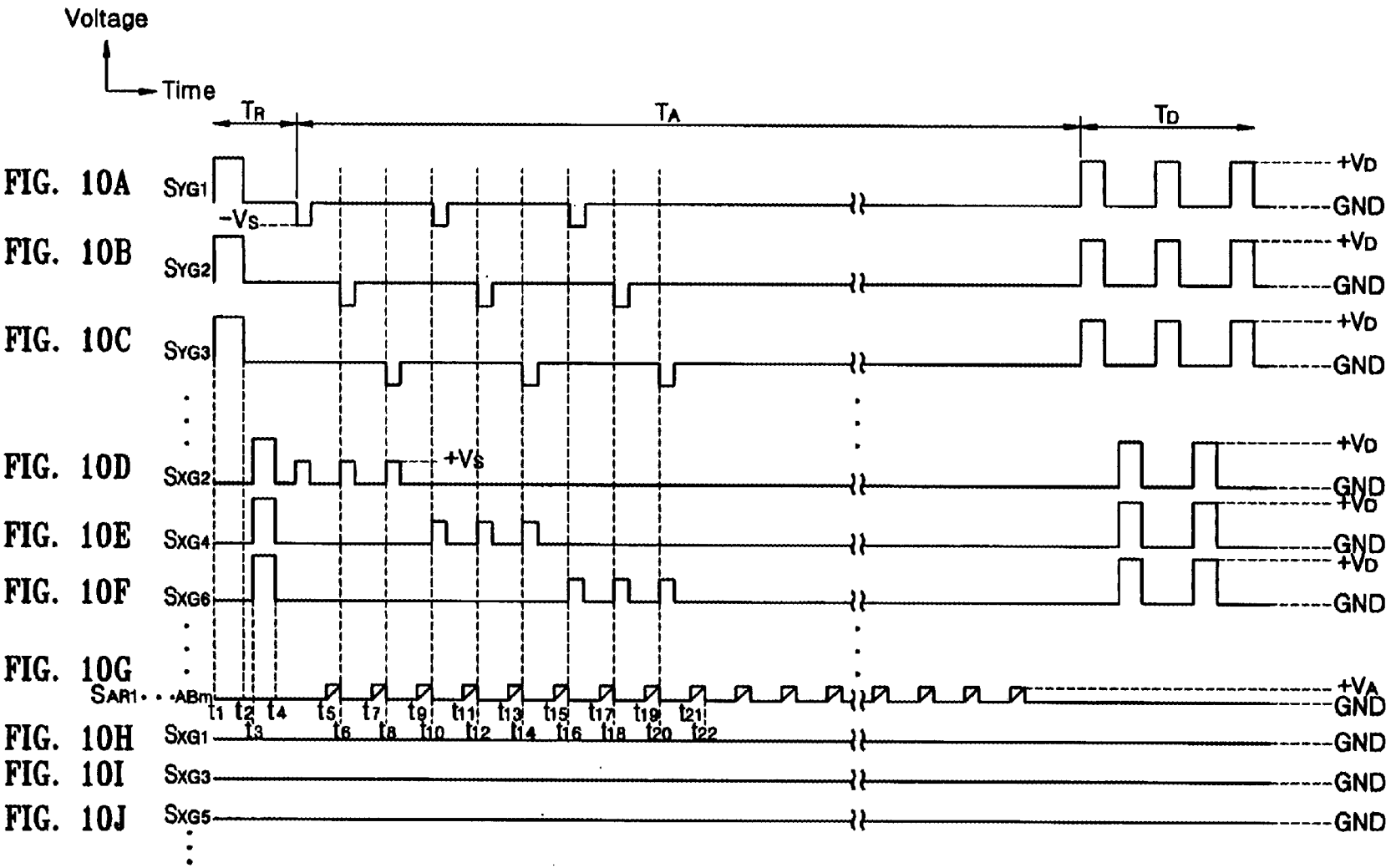
FIGS. 10A through 10J are driving timing charts of unit sub-fields in an even field in the wiring structure of FIG. 8.

Referring to FIG. 8, a plasma display panel 84 to which a driving method according to a further embodiment of the present invention is applied has a structure in which two X electrode lines are formed between adjacent Y electrode lines so that the total number of X electrode lines $X_1, \ldots, X_n$ is "n" and the total number of Y electrode lines $Y_1, \ldots, Y_{n/2}$ is n/2. Thus two adjacent X electrode lines pair with different Y electrode lines.

The X electrode lines $X_1, \ldots, X_n$ are divided into n/6 X groups $X_{G1}, X_{G3}, X_{G5}, \ldots, X_{G(n/3)-1}$ of odd X electrode lines, and n/6 X groups $X_{G2}, X_{G4}, X_{G6}, \ldots, X_{G(n/3)}$ of even X electrode lines. The Y electrode lines $Y_1, \ldots, Y_{n/2}$ are divided into n/6 Y groups $Y_{G1}, \ldots, Y_{G(n/6)}$. Pairs of XY groups $X_{G1}Y_{G1}, Y_{G1}X_{G2}, X_{G1}Y_{G2}, Y_{G2}X_{G2}, \ldots, Y_{G(n/6)}X_{G(n/3)}$ including respective pairs of adjacent X and Y electrodes $X_1Y_1, Y_1X_2, X_3Y_2, Y_2X_4, \ldots, Y_{n/2}X_n$ are separately set. Accordingly, the X and Y electrode lines are commonly connected to one another in units of odd X groups $X_{G1}, X_{G3}, X_{G5}, \ldots, X_{G(n/3)-1}$, even X groups $X_{G2}, X_{G4}, X_{G6}, \ldots, X_{G(n/3)}$, and Y groups $Y_{G1}, \ldots, Y_{G(n/6)}$.

An address driver 83 generates a data signal to drive address electrode lines $A_{R1}, A_{G1}, \ldots, A_{Gm}, A_{Bm}$. An X driver 82 drives the X groups $X_{G1}, X_{G2}, X_{G3}, \ldots, X_{G(n/3)}$, and a Y driver 81 drives Y groups $Y_{G1}, \ldots, Y_{G(n/6)}$.

FIGS. 9A through 9J are driving timing charts of unit sub-fields in an odd field in the wiring structure of FIG. 8. Reference characters $S_{YG1}, S_{YG2}, S_{YG3}, \ldots$ denote driving signals applied to the Y groups ($Y_{G1}, Y_{G2}, Y_{G3}, \ldots, Y_{G(n/6)}$ of FIG. 8), respectively. Reference characters $S_{XG1}, S_{XG3}, S_{XG5}, \ldots$ denote driving signals for the odd X groups ($X_{G1}$, $X_{G3}, X_{G5}, \ldots, X_{G(n/3)-1}$ of FIG. 8), respectively. Reference character $S_{AR1}, \ldots, A_{Bm}$ denotes a data signal applied to all the address electrode lines ($A_{R1}, A_{G1}, \ldots, A_{Gm}, A_{Bm}$ of FIG. 8). Reference characters $T_R$, $T_A$ and $T_D$ denote a reset period, an address period, and a display period, respectively.

In the interval between a point t1 and a point t2 during the reset period $T_R$, a first pulse of a positive voltage $+V_D$ is applied to all the Y groups $Y_{G1}, Y_{G2}, Y_{G3}, \ldots, Y_{G(n/6)}$. Here, since the pulse has a long width between the point t1 and the point t2, a discharge occurs in all discharge cells to form the wall charges therein. Subsequently, during the interval between a point t3 and a point t4, a second pulse of a positive voltage $+V_D$ is applied to all the odd X groups $X_{G1}, X_{G3}, X_{G5}, \ldots, X_{G(n/3)-1}$ to erase the wall charges from all the odd discharge cells.

During the address period $T_A$, in the order of the horizontal lines, the wall charges are formed in all the odd discharge cells, and then the wall charges are erased from ones of the odd discharge cells which are not to be displayed.

During the interval between the point t4 and a point t5, scan pulses having different polarities are applied to the Y group $Y_{G1}$ and the odd X group $X_{G1}$, respectively, corresponding to the first odd discharge cells. In other words, a pulse of a negative voltage $-V_S$ is applied to the Y group $Y_{G1}$, and a pulse of a positive voltage $+V_S$ is applied to the odd X group $X_{G1}$. As a result, wall charges are satisfactorily formed in the first odd discharge cells.

Subsequently, during the interval between the point t5 and a point t6, a data signal corresponding to the first odd discharge cells is applied to all the address electrode lines $A_{R1}, A_{G1}, \ldots, A_{Gm}, A_{Bm}$, thereby erasing the wall charge from discharge cells which are not to be displayed among the first odd discharge cells having the wall charges. Here, the voltage $+V_A$ and the width of the address pulse are set to be proper to erase the wall charges.

The above-described addressing operations are sequentially performed on the remaining odd discharge cells.

Next, during the display period $T_D$, a pulse of a positive voltage $+V_D$ is alternately applied to all the Y groups $Y_{G1}$, $YG_2, Y_{G3}, \ldots, Y_{G(n/6)}$ and all the odd X groups $X_{G1}, X_{G3}, X_{G5} \ldots, X_{G(n/3)-1}$, thereby provoking the display discharge in ones of the discharge cells from which the wall charges have not been erased during the address period $T_A$. Here, since the positive wall charges are formed around the Y electrode lines corresponding to the discharge cells from which the wall charges have not been erased during the address period $T_A$, a display pulse of the positive voltage $+V_D$ is applied to all the Y groups $Y_{G1}, Y_{G2}, Y_{G3}, \ldots, Y_{G(n/6)}$ for the first time.

Meanwhile, since a ground voltage GND is continuously applied to all the even X groups $X_{G2}, X_{G4}, X_{G6}, \ldots, X_{G(n/3)}$, ineffective power can be reduced.

FIGS. 10A through 10J are driving timing charts of unit sub-fields in an even field in the wiring structure of FIG. 8. In FIGS. 10A through 10J and 9A through 9J, the same reference numeral denotes members having the same function.

In the interval between a point t1 and a point t2 during a reset period $T_R$, a first pulse of a positive voltage $+V_D$ is applied to all the Y groups $Y_{G1}, Y_{G2}, Y_{G3}, \ldots, Y_{G(n/6)}$. Here, since the pulse having a long width between the point t1 and the point t2 is applied, the discharge occurs in all the discharge cells, thereby forming the wall charges therein. Subsequently, during the interval between a point t3 and a point t4, a second pulse of a positive voltage $+V_D$ is applied to all the even X groups $X_{G2}, X_{G4}, X_{G6}, \ldots, X_{G(n/3)}$, thereby erasing the wall charges from all even discharge cells.

During an address period $T_A$, in the order of the horizontal lines, the wall charges are formed in all the even discharge cells and then the wall charges are erased from ones of the even discharge cells which are not to be displayed.

During the interval between the point t4 and a point t5, scan pulses having different polarities are applied to the Y group $Y_{G1}$ and the even X group $X_{G2}$, respectively, corresponding to the first even discharge cells. In other words, a pulse of a negative voltage $-V_S$ is applied to the Y group $Y_{G1}$, and a pulse of a positive voltage $+V_S$ is applied to the even X group $X_{G2}$. As a result, the wall charges are satisfactorily formed in the first even discharge cells.

Subsequently, during the interval between the point t5 and a point t6, a data signal corresponding to the first even discharge cells is applied to all the address electrode lines $A_{R1}, A_{G1}, \ldots, A_{Gm}, A_{Bm}$, thereby erasing the wall charge from the discharge cells which are not to be displayed among the first even discharge cells having the wall charges. Here, the voltage $+V_A$ and the width of an address pulse are set to be proper to erase the wall charges.

The above-described addressing operations are sequentially performed on the remaining even discharge cells.

Next, during a display period $T_D$, a pulse of a positive voltage $+V_D$ is alternately applied to all the Y groups $Y_{G1}$, $YG_2, Y_{G3}, \ldots, Y_{G(n/6)}$ and all the even X groups $X_{G2}, X_{G4}, X_{G6}, \ldots, X_{G(n/3)}$, thereby provoking a display discharge in the discharge cells from which the wall charges have not been erased during the address period $T_A$. Here, since the positive wall charges are formed around the Y electrode lines corresponding to the discharge cells from which the wall charges have not been erased during the address period $T_A$, a display pulse of the positive voltage $+V_D$ is applied to all the Y groups $Y_{G1}, Y_{G2}, Y_{G3}, \ldots, Y_{G(n/6)}$ for the first time.

Meanwhile, since a ground voltage GND is continuously applied to all the odd X groups $X_{G1}, X_{G3}, X_{G5}, \ldots, X_{G(n/3)-1}$, ineffective power can be reduced.

As described above, in a method of driving a plasma display panel according to the present invention, the discharge cells are set with respect to both X electrode lines adjacent to a common Y electrode line, the X electrode lines are divided into odd X groups and even X groups, and interlaced scanning is performed by an odd driving step and an even driving step to realize a line duplication driving method. In addition, the Y electrode lines are divided into Y groups, and pairs of X and Y groups including pairs of adjacent X and Y electrode lines, respectively, are separately set. The odd and even driving steps are performed in this structure, thereby realizing an AND-logic driving method. Accordingly, not only are the number of driving devices of the X and Y driving circuits reduced due to the AND-logic driving method, but the number of X and Y driving lines are also reduced due to the line duplication driving method.

While this invention has been particularly shown and described with reference to preferred embodiments thereof, it will be understood by those skilled in the art that various changes in form and details may be made therein without departing from the spirit and scope of the invention as defined by the claims and equivalents thereof.

What is claimed is:

1. A method of driving a plasma display panel having front and rear substrates disposed opposite each other, X electrode lines and Y electrode lines arranged parallel to each other on the front substrate between the front and rear substrates, and address electrode lines arranged in a direction orthogonal to a direction of the X and Y electrode lines to define discharge cells at intersections thereof, the discharge cells being further defined as being an odd discharge cell if between each Y electrode line and an adjacent X electrode line above and an even discharge cell for each Y electrode line and an adjacent X electrode below, the method comprising:

wiring the electrode lines by dividing the X electrode lines into X groups including odd X groups and even X groups, dividing the Y electrode lines into Y groups, separately setting pairs of X and Y groups including pairs of adjacent X and Y electrode lines, respectively to define the odd and even discharge cells, commonly connecting the X and Y electrode lines to one another in units of the odd X groups, the even X groups, and the Y groups;

driving the Y groups, the X groups, and the address electrode lines in an odd field to drive the odd discharge cells in a vertical direction; and driving the Y groups, the X groups, and the address electrode lines in an even field to drive the even discharge cells in a vertical directions, wherein:

a single Y electrode line is formed between adjacent X electrode lines in the plasma display panel so that a total number of the X electrode lines is "n " and a total number of the Y electrode lines is n−1.

2. method of claim 1, wherein:

in said wiring the electrode lines, a number of the Y groups corresponding to each of the odd X groups is the same as a number of the Y groups corresponding to each of the even X group, with the exception that a number of the Y groups corresponding to a last one of the odd X groups includes one more X group than a number of the Y groups corresponding to each of the remaining X groups.

3. The method of claim 2, wherein said driving the odd discharge cells comprises:

applying a first pulse to all of the X groups to erase wall charges from all of the discharge cells;

forming the wall charges in all the odd discharge cells and then erasing the wall charges from ones of the odd discharge cells that will not be displayed in order of a horizontal line;

alternately applying a second pulse to all of the Y groups and all of the X groups to provoke a display discharge in ones of the discharge cells from which the wall charges have not been erased; and repeating the applying the first pulse, the forming and erasing of the wall charges, and the provoking the display discharge in each sub-field.

4. The method of claim 3, wherein the forming and erasing the wall charges comprises:

applying scan pulses having different polarities to a Y group and an X group, respectively, which correspond to one odd line of the odd discharge cells to form the wall charges in the odd discharge cells on the odd line;

applying a data signal corresponding to the odd discharge cells on the odd line to all of the address electrode lines to erase the wall charges from ones of the odd discharge cells which will not be displayed among the odd discharge cells on the odd line having the wall charges; and sequentially applying the scan pulses and the applying the data signals to the odd discharge cells on the remaining odd lines line by line.

5. The method of claim 4, wherein the sequentially applying the scan pulses and the data pulses to the odd discharge cells further comprises inverting polarities of the scan pulses for each sequential data pulse in order not to influence states of the even discharge cells adjacent to the odd discharge cells.

6. The method of claim 2, wherein said driving the even discharge cells comprises:

applying a first pulse to all the X groups to erase the wall charges from all of the discharge cells;

forming the wall charges in all of the even discharge cells and then erasing the wall charges from ones of the even discharge cells that will not be displayed in order of a horizontal line;

alternately applying a second pulse to all of the Y groups and all of the X groups to provoke the display discharge in ones of the discharge cells from which the wall charges have not been erased; and repeating the forming and erasing the wall charges and the provoking the display discharge in each sub-field.

7. The method of claim 6, wherein the forming and erasing the wall charges comprises:

applying scan pulses having different polarities to one of the Y groups and one of the X groups, respectively, which correspond to one even line of the even discharge cells to form the wall charges in the even discharge cells on the even line;

applying a data signal corresponding to the even discharge cells on the even line to all the address electrode lines to erase the wall charges from ones of the even discharge cells which will not be displayed among the even discharge cells on the even line having the wall charges; and sequentially applying the scan pulses and the data signals to the even discharge cells of the remaining even lines line by line.

8. The method of claim 7, wherein the sequentially applying the scan pulses and the data signals further comprises inverting polarities of the scan pulses applied to the discharge cells for each successive data pulse in order to not influence states of the odd discharge cells adjacent the even discharge cells.

9. A method of driving a plasma display panel having front and rear substrates disposed opposite each other, X electrode lines and Y electrode lines arranged parallel to each other on the front substrate between the front and rear substrates, and address electrode lines arranged in a direction orthogonal to a direction of the X and Y electrode lines to define discharge cells at intersections thereof, the discharge cells being further defined as being an odd discharge cell if between each Y electrode line and an adjacent X electrode line above and an even discharge cell for each Y electrode line and an adjacent X electrode below, the method comprising:

wiring the electrode lines by dividing the X electrode lines into X groups including odd X groups and even X groups, dividing the Y electrode lines into Y groups, separately setting pairs of X and Y groups including pairs of adjacent X and Y electrode lines, respectively to define the odd and even discharge cells, commonly connecting the X and Y electrode lines to one another in units of the odd X groups, the even X groups, and the Y groups;

driving the Y groups, the X groups, and the address electrode lines in an odd field to drive the odd discharge cells in a vertical direction; and driving the Y groups, the X groups, and the address electrode lines in an even field to drive the even discharge cells in a vertical direction, wherein:

two X electrode lines are formed between corresponding adjacent Y electrode lines so that a total number of the X electrode lines is "n" and a total number of the Y electrode lines is n/2, the adjacent two X electrode lines pair with different Y electrode lines, respectively, and said driving the odd discharge cells comprises:

applying a first pulse to all the Y groups and then applying a second pulse to all the odd X groups to erase wall charges from the odd discharge cells in the vertical direction;

forming the wall charges in all the odd discharge cells and then erasing the wall charges from ones of the odd discharge cells that will not be displayed in order of a horizontal line;

alternately applying a third pulse to all of the Y groups and all of the odd X groups to provoke a display discharge in ones of the odd discharge cells from which the wall charges have not been erased; and repeating the forming and erasing the wall charges and provoking the display discharge in each sub-field.

10. The method of claim 9, wherein the forming and erasing the wall charges from ones of the odd discharge cells comprises:

applying scan pulses having different polarities to one of the Y groups and one of the odd X groups, respectively, which correspond to one odd line of the odd discharge cells to form the wall charges in the odd discharge cells on the odd line;

applying a data signal corresponding to the odd discharge cells on the odd line to all of the address electrode lines to erase the wall charges from ones of the odd discharge cells which will not be displayed among the odd discharge cells on the odd line having the wall charges; and sequentially applying the scan pulses and the data signal to the odd discharge cells of the remaining odd lines line by line.

11. The method of claim 9, wherein said driving the even discharging cells comprises:

applying a fourth pulse to all of the Y groups and then applying a fifth pulse to all of the even X groups to erase the wall charges from the even discharge cells in the vertical direction;

forming the wall charges in all of the even discharge cells and then erasing the wall charges from ones of the even discharge cells that will not be displayed in order of the horizontal line; and alternately applying a sixth pulse to all of the Y groups and all of the even X groups to provoke a display discharge in ones of the even discharge cells from which the wall charges have not been erased, and repeating the forming and erasing wall charges, and provoking the display discharge in each sub-field.

12. The method of claim 11, wherein the forming and erasing the wall charges in ones of the even discharge cells comprises:

applying scan pulses having different polarities to one of the Y groups and one of the even X groups, respectively, which correspond to one even line of the even discharge cells to form the wall charges in the even discharge cells on the even line;

applying a data signal corresponding to the even discharge cells on the even line to all of the address electrode lines to erase the wall charges from one of the even discharge cells which will not be displayed among the even discharge cells on the even line having the wall charges; and sequentially applying the scan pulses and the data signal to the even discharge cells of the remaining even lines line by line.

13. A method of driving a plasma display panel, the plasma display panel comprising a front substrate, X electrode lines and Y electrode lines arranged on the front substrate in a first direction, a rear substrate, and address electrode lines arranged on the rear substrate opposite the X and Y electrode lines in a second direction orthogonal to the first direction to define discharge cells including even and odd discharge cells at intersections thereof, wherein, for each one of the Y electrode lines, the odd discharge cells are between the one Y electrode line and an adjacent X electrode line above, and the even discharge cells are between the one Y electrode line and an adjacent X electrode below, and the X electrode lines are commonly connected in X groups including odd X groups and even X groups, and the Y electrode lines are commonly in Y groups such that pairs of X and Y groups include pairs of adjacent X and Y electrode lines, the method comprising:

driving the Y groups, the X groups, and the address electrode lines to drive the odd discharge cells to perform a display discharge in an odd field; and driving the Y groups, the X groups, and the address electrode lines to drive the even discharge cells to perform a display discharge in an even field, wherein said driving the odd discharge cells comprises:

applying a pulse to the X groups to erase wall charges from the discharge cells;

selectively forming the wall charges in ones of the odd discharge cells to be displayed without forming the wall charges in ones of the odd discharge cells not to be displayed; and alternately applying a second pulse to the Y groups and the X groups to provoke a display discharge in ones of the odd discharge cells to be displayed in the odd field.

14. The method of claim 13, wherein the selectively forming and erasing the wall charges in the odd discharge cells comprises:

applying scan pulses having different polarities to one of the Y groups and one of the X groups, respectively, which correspond to one of the odd lines of the odd discharge cells to form the wall charges in the odd discharge cells of the one odd line; and applying a data signal corresponding to the odd discharge cells of the one odd line to the address electrode lines to erase the wall charges from ones of the odd discharge cells not to be displayed.

15. The method of claim 14, wherein the selectively forming and erasing the wall charges in the odd discharge cells further comprises:

applying scan pulses having different polarities to another one of the Y groups and another one of the X groups, respectively, wherein the scan pulses applied to the another X group have a polarity that is opposite a polarity of the one X group.

16. The method of claim 14, wherein said driving the even discharge cells comprises:

applying a third pulse to the X groups to erase the wall charges from the discharge cells;

selectively forming the wall charges in ones of the even discharge cells to be displayed without forming the wall charges in ones of the even discharge cells not to be displayed;

alternately applying a fourth pulse to the Y groups and additional ones of the X groups to provoke a display discharge in ones of the even discharge cells to be displayed in the even field.

17. A plasma display apparatus comprising:

a front substrate;

X and Y electrode lines arranged on said front substrate in a first direction, each of said Y electrode lines being disposed between adjacent pairs of said X electrode lines, said X electrode lines being organized into X groups including odd X groups and even X groups, and said Y electrode lines being organized into Y groups such that pairs of the X and Y groups include pairs of adjacent said X and Y electrode lines;

a rear substrate, address electrode lines arranged on said rear substrate opposite said X and Y electrode lines in a second direction orthogonal to the first direction to define even and odd discharge cells at intersections thereof;

an X driver to drive said X electrode lines commonly connected in the X groups;

a Y driver to drive said Y electrode lines commonly connected in the Y groups; and an address driver to drive said address electrode lines, wherein for each one of said Y electrode lines, the odd discharge cells are defined between said one Y electrode line and an adjacent one of said X electrode lines to one side of said one Y electrode line, and the even discharge cells are defined between said one Y electrode line and an adjacent one of said X electrodes lines to another side of said one Y electrode line, said X, Y, and address drivers drive the Y groups, the odd X groups, and the address electrode lines to drive the odd discharge cells to perform a display discharge in an odd field, said X, Y, and address drivers drive the Y groups, the even X groups, and the address electrode lines to drive the even discharge cells to perform a display discharge in an even fields, said Y driver comprises Y driver units that drive corresponding ones of the Y groups, and a number of the Y driver units is less than a number of said Y electrode lines, and a number of the Y driver units is less than both a number of said Y electrode lines and a number of the X driver units.

18. The plasma display apparatus of 17, wherein said X driver comprises X even and odd driver units that drive corresponding ones of the even and odd X groups, and a number of the X driver units is less than a number of said X electrode lines.

19. The plasma display apparatus of claim 17, wherein there is one more of said X electrode lines than of said Y electrode lines.

20. The plasma display apparatus of claim 17, wherein there are twice as many of said X electrode lines as of said Y electrode lines.

21. The plasma display apparatus of claim 20, wherein adjacent pairs of Y electrode lines have a pair of said X electrode lines therebetween.

22. A method of wiring a plasma display panel, the plasma display panel including a front substrate, X electrode lines and Y electrode lines arranged on the front substrate in a first direction, each of the Y electrode lines having one of the X electrode lines on each adjacent side, a rear substrate, and address electrode lines arranged on the rear substrate opposite the X and Y electrode lines in a second direction orthogonal to the first direction to define even and odd discharge cells at intersections thereof, the method comprising:

grouping the X electrode lines into X groups including odd X groups and even X groups, where each of the odd and even X groups are commonly driven by corresponding odd and even X drivers; and combining the Y electrode lines into Y groups such that pairs of the X and Y groups include pairs of adjacent X and Y electrode lines, where each of the Y groups are commonly driven by corresponding Y drivers, wherein a number of the odd and even X drivers is less than a number of the X electrode lines, and a number of the Y drivers is less than a number of the Y electrode lines and is less than a number of the X drivers.

23. The method of claim 22, wherein there is one more of the X electrode lines than of the Y electrode lines.

24. The method of claim 22, wherein there are twice as many of the X electrode lines as of the Y electrode lines.

25. The method of claim 24, wherein adjacent pairs of the Y electrode lines have a pair of X electrode lines therebetween.

* * * * *

UNITED STATES PATENT AND TRADEMARK OFFICE

CERTIFICATE OF CORRECTION

PATENT NO. : 6,747,615 B2
DATED : June 8, 2004
INVENTOR(S) : Jae-Seok Jeong

It is certified that error appears in the above-identified patent and that said Letters Patent is hereby corrected as shown below:

Column 9,
Line 20, delete “directions” and insert -- direction --.
Line 24, delete “n ” and insert -- n --.

Column 13,
Line 42, delete “fields” and insert -- field --.

Signed and Sealed this

Fifth Day of October, 2004

JON W. DUDAS
*Director of the United States Patent and Trademark Office*